US007000695B2

(12) United States Patent
Steele et al.

(10) Patent No.: US 7,000,695 B2
(45) Date of Patent: Feb. 21, 2006

(54) EXPANDING WELLBORE JUNCTION

(75) Inventors: David J. Steele, Irving, TX (US); Ernest C. Bailey, Dallas, TX (US); Jody R. McGlothen, Waxahachie, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 79 days.

(21) Appl. No.: 10/137,611

(22) Filed: May 2, 2002

(65) Prior Publication Data

US 2003/0205379 A1 Nov. 6, 2003

(51) Int. Cl.
*E21B 7/08* (2006.01)
*E21B 23/00* (2006.01)

(52) U.S. Cl. ..... 166/117.6; 166/50; 166/242.1

(58) Field of Classification Search ..... 166/50, 166/313, 117.6, 242.1
See application file for complete search history.

(56) References Cited

U.S. PATENT DOCUMENTS

| | | | | |
|---|---|---|---|---|
| 5,318,122 A | | 6/1994 | Murray et al. | |
| 5,330,007 A | | 7/1994 | Collins et al. | |
| 5,348,095 A | | 9/1994 | Worrall et al. | |
| 5,388,648 A | | 2/1995 | Jordan, Jr. | |
| 5,462,120 A | | 10/1995 | Gondouin | |
| 5,655,602 A | | 8/1997 | Collins | |
| 5,695,008 A | | 12/1997 | Bertet et al. | |
| 5,718,288 A | | 2/1998 | Bertet et al. | |
| 6,056,059 A | * | 5/2000 | Ohmer | 166/313 |
| 6,135,208 A | * | 10/2000 | Gano et al. | 166/313 |
| 6,283,216 B1 | | 9/2001 | Ohmer | |
| 6,336,507 B1 | * | 1/2002 | Collins | 166/313 |
| 6,564,867 B1 | * | 5/2003 | Ohmer | 166/285 |
| 2002/0023745 A1 | * | 2/2002 | George et al. | 166/50 |
| 2002/0023753 A1 | * | 2/2002 | Buytaert | 166/313 |
| 2003/0141074 A1 | * | 7/2003 | Freeman | 166/380 |
| 2003/0178204 A1 | * | 9/2003 | Echols et al. | 166/386 |

FOREIGN PATENT DOCUMENTS

| | | |
|---|---|---|
| EP | 0 961 007 A2 | 12/1999 |
| WO | WO 99/04135 A1 | 1/1999 |
| WO | WO 99/13195 A1 | 3/1999 |
| WO | WO 02/29207 A1 | 4/2002 |
| WO | WO 02/29208 A1 | 4/2002 |

OTHER PUBLICATIONS

Tri–State General Catalog Front Cover, Index p. 2, p. 52; Dated 1980–81.
Search Report For Counterpart United Kingdom Application No.: 0309628.6.

* cited by examiner

*Primary Examiner*—Hoang Dang
(74) *Attorney, Agent, or Firm*—Marlin R. Smith

(57) ABSTRACT

An expanding wellbore junction system, apparatus and methods are provided for forming a sealed wellbore intersection in a subterranean well. In one described method, an expandable wellbore junction is expanded within an under-reamed cavity in a wellbore. Intersecting tubular legs of the wellbore junction are then drifted using a drifting apparatus. A deflection device may be used to direct a drift of the drifting apparatus into a selected one of the wellbore junction legs.

6 Claims, 6 Drawing Sheets

EXPANDING WELLBORE JUNCTION

BACKGROUND

The present invention relates generally to operations performed, and equipment utilized, in conjunction with a subterranean well and, in an embodiment described herein, more particularly provides an expanding wellbore junction method.

It is well known in the art to expand a wellbore junction downhole as part of a method of interconnecting multiple intersecting wellbores. However, such prior methods suffer from at least one of several deficiencies. Firstly, it is difficult to seal against an expanded tubular member, since an expanded tubular member rarely, if ever, returns to a uniform cylindrical shape. Secondly, an expanded wellbore junction typically has a somewhat misshapen form, which makes access therethrough, and positioning of various devices therein, very difficult. Thirdly, the positioning, expanding, sealing, etc. steps involved in utilizing an expandable wellbore junction typically require an excessive number of trips into the well, which is time-consuming and expensive.

From the foregoing, it can be seen that it would be quite desirable to provide expanding wellbore junction methods, systems and apparatus which solve one or more of the above problems in the art.

SUMMARY

In carrying out the principles of the present invention, in accordance with embodiments thereof, expanding wellbore junction methods, systems and apparatus are provided, each of which solves at least one of the above problems in the art.

In one aspect of the invention, a method of forming a sealed wellbore intersection in a subterranean well is provided. The method includes the steps of drilling a first wellbore, under-reaming the first wellbore, thereby forming a radially enlarged cavity, positioning an expandable wellbore junction within the cavity, expanding the wellbore junction within the cavity, forcing a drift through at least one of multiple tubular legs of the wellbore junction, cementing the wellbore junction within the cavity, drilling a second wellbore through a first one of the tubular legs of the wellbore junction, and drilling a third wellbore through a second one of the tubular legs of the wellbore junction.

In another aspect of the invention, an expandable wellbore junction system is provided. The system includes a wellbore junction assembly. The wellbore junction assembly includes an expandable wellbore junction having multiple intersecting tubular legs, and an orienting latch profile attached to the wellbore junction. The orienting latch profile may be used to radially orient various item of equipment relative to the wellbore junction, such as, a deflection device, a drifting apparatus, a drilling whipstock, etc.

In yet another aspect of the invention, a drifting apparatus for use in a wellbore junction installed in a subterranean well is provided. The apparatus includes a drift, a displacement device displacing the drift in the wellbore junction, and a securing device securing the apparatus relative to the wellbore junction. The apparatus may be pressure actuated and may be conveyed into the well, and retrieved from the well, with a deflection device in a single trip into the well.

In still another aspect of the invention, a deflection device assembly for use in an expandable wellbore junction is provided. The assembly includes a deflection device. The deflection device includes a laterally inclined deflection surface, a generally tubular neck, and a substantially flexible intermediate section connected between the neck and the deflection surface, the intermediate section flexing when the deflection device is installed in the wellbore junction, thereby permitting relative angular deflection between the deflection surface and the neck. This angular deflection may permit installation of the deflection device in an imperfectly expanded wellbore junction.

In a further aspect of the invention, a method of drifting an expandable wellbore junction in a subterranean well is provided. The method includes the steps of conveying a drifting apparatus into the wellbore junction, and displacing a drift of the drifting apparatus in at least one of multiple intersecting tubular legs of the wellbore junction. A pressure actuated knuckle joint or another deflection device may be used if desired to direct the drift into a selected one of the tubular legs.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 2:
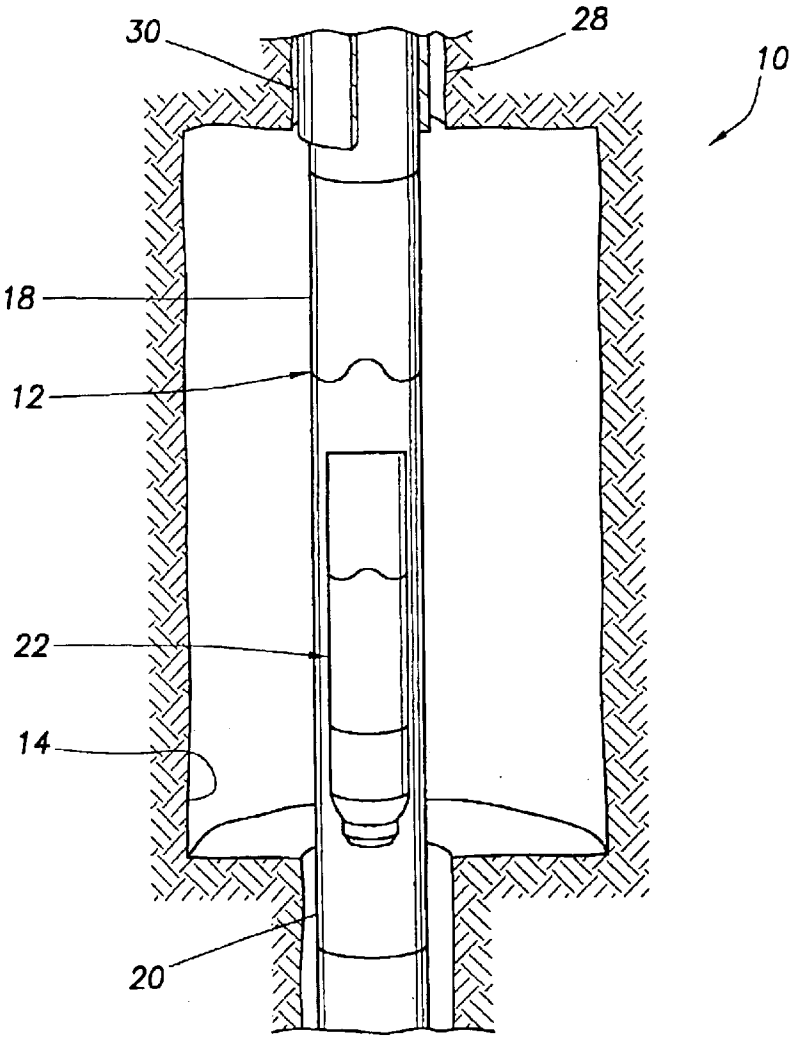
FIG. 2 is a cross-sectional perspective view of the method, wherein an expandable junction has been positioned in an under-reamed cavity.

Representatively illustrated in FIGS. 1–4 and 8–10 is an expanding wellbore junction method 10 which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

In the method 10, an expandable wellbore junction 12 is positioned within an under-reamed cavity 14, the wellbore junction is expanded outward, a drift 16 is displaced in each of three intersecting branches or legs 18, 20, 22 of the wellbore junction, and the wellbore junction is cemented within the cavity. Additional wellbores 24, 26 may then be drilled through each of the lower legs 20, 22 of the wellbore junction 12. The method 10 provides a stable, sealed and strong wellbore intersection which is efficient and economical to install.

Figure 1:
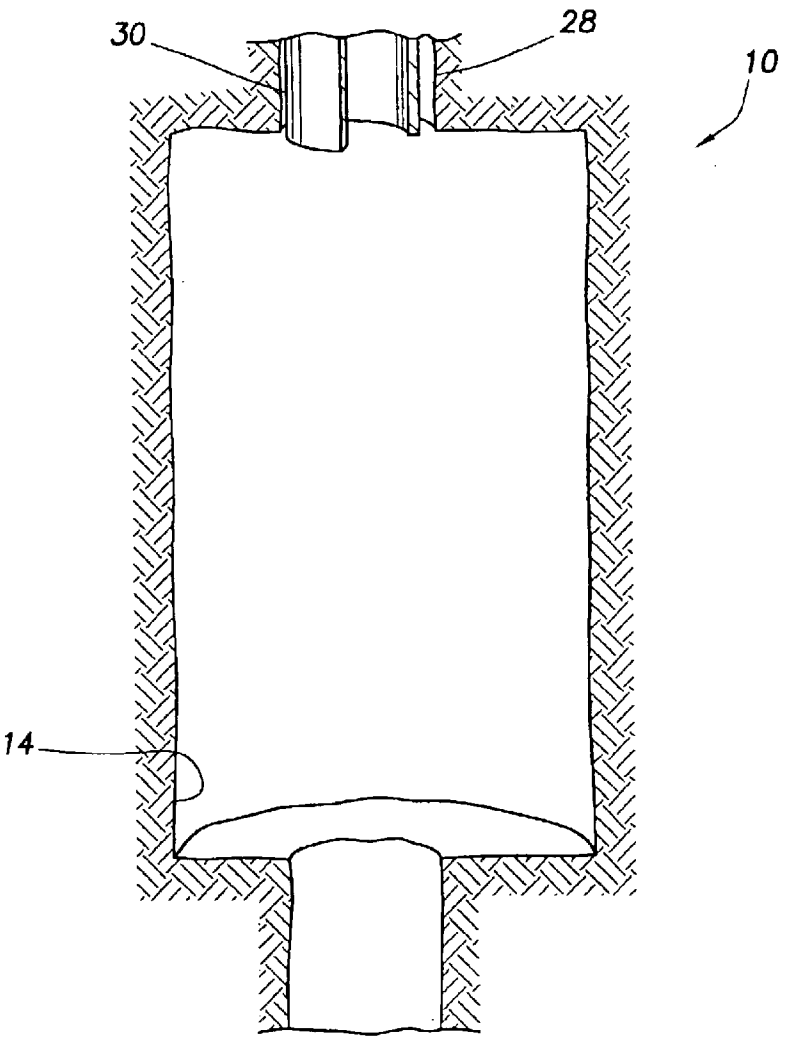
FIG. 1 is a cross-sectional perspective view of a method embodying principles of the present invention, wherein initial steps of the method have been performed.

Referring specifically now to FIG. 1, initial steps of the method 10 have been performed. A wellbore 28 has been drilled in the earth and a tubular string 30 has been installed in the wellbore. The wellbore 28 may extend to the earth's surface, to another wellbore, or to any other point of origin.

The tubular string 30 may be a casing string, a liner string, or any other type of tubular string. The tubular string 30 may be cemented in the wellbore 28 upon installation, or the cementing may be performed later in the method 10.

The cavity 14 is then formed in the wellbore 28. As depicted in FIG. 1, the cavity 14 is formed by under-reaming the wellbore 28, so that the cavity is radially enlarged relative to the wellbore 28 above the cavity. However, it is to be understood that other means of enlarging the wellbore 28 to accommodate the expanded wellbore junction 12 may be used in keeping with the principles of the invention. For example, the wellbore 28 could be extended laterally without under-reaming. Thus, any means of forming the cavity 14 may be used.

Figure 9:
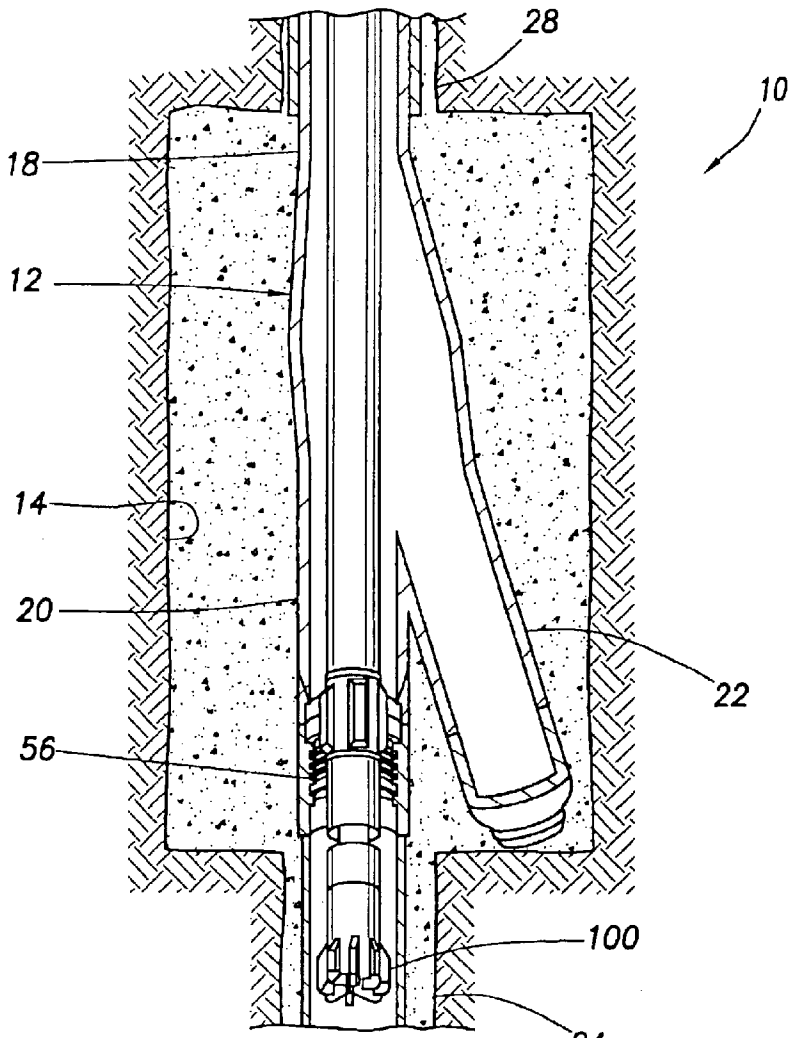
FIG. 9 is a cross-sectional perspective view of the method, wherein a wellbore is drilled through one lower leg of the junction.

Note that the wellbore 28 may extend below the cavity 14 any distance, or not at all. If the wellbore 28 is drilled to its terminal depth prior to installation of the expandable wellbore junction 12, then there may be no need to drill the wellbore 24 through the expanded wellbore junction as depicted in FIG. 9. As described herein, it is assumed that the wellbore 28 extends somewhat below the cavity 14, but the wellbore is further drilled to form the wellbore 24 below the wellbore junction 12 after it is installed. However, it should be understood that this is merely one example of the many various ways in which the principles of the invention may be practiced.

Figure 6:
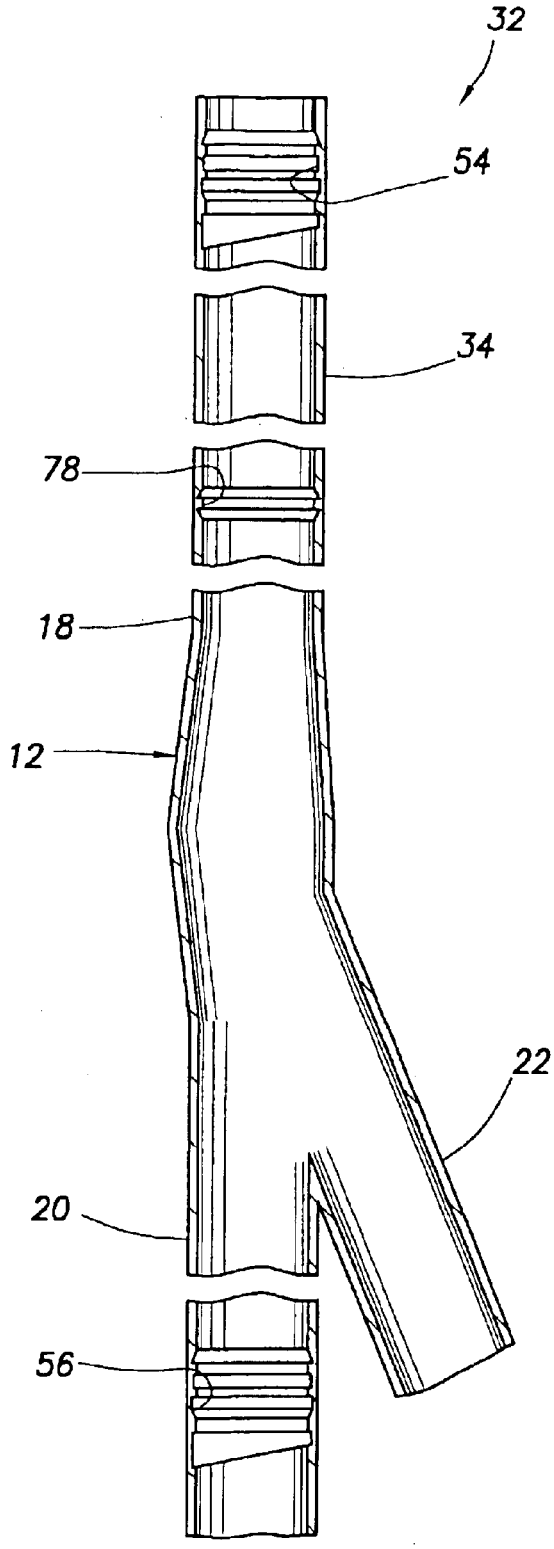
FIG. 6 is a cross-sectional view of a junction assembly configured for use of the apparatus therein, the junction assembly embodying principles of the invention.

Referring specifically now to FIG. 2, the wellbore junction 12 is positioned in the cavity 14 as a part of an overall wellbore junction assembly 32. One preferred example of the wellbore junction assembly 32 is depicted in FIG. 6 and is described in greater detail below. However, the specific equipment used in the junction assembly 32 described herein is not required for practicing the principles of the invention, as a variety of changes may be made to the assembly, if desired to suit a particular application.

As depicted in FIG. 2, the wellbore junction 12 is in its collapsed configuration. The junction 12 is preferably made of interconnected generally tubular metal elements which, after they are connected together, are mechanically collapsed so that the junction may pass through the tubular string 30. The junction 12 is preferably expanded by inflating, that is, by applying pressure to its interior to force the tubular elements to expand outward and assume their prior interconnected shapes, as described below. However, any type of wellbore junction, made of any type of material and expanded by any means, may be used in keeping with the principles of the invention.

The junction assembly 32 is preferably composed substantially of liner 34 above the wellbore junction 12. The liner 34 is anchored to the tubular string 30, for example, using a conventional liner hanger (not shown) of the type well known to those skilled in the art. Other means of securing the junction assembly 32 to the tubular string 30, or other means of anchoring the junction assembly so that the junction 12 is positioned in the cavity 14, may be used in keeping with the principles of the invention.

Prior to anchoring the junction assembly 32, the leg 22 is radially oriented so that, when the junction 12 is expanded and cemented within the cavity 14, the expanded leg will face in a desired direction for drilling the wellbore 26. For convenience of description, the leg 22 will be referred to as a "lateral" leg, since in the illustrated embodiment the leg 22 extends somewhat laterally relative to the remainder of the junction 12, but it is to be clearly understood that it is not necessary for the leg 22 to extend laterally at all.

For reasons explained below, it may be desired to orient the lateral leg 22 toward the high side of the wellbore 28 when the wellbore is not vertical. Other orientations may be desired to suit other circumstances, and in some instances a particular orientation for either of the legs 20, 22 may not be desired.

Figure 3:
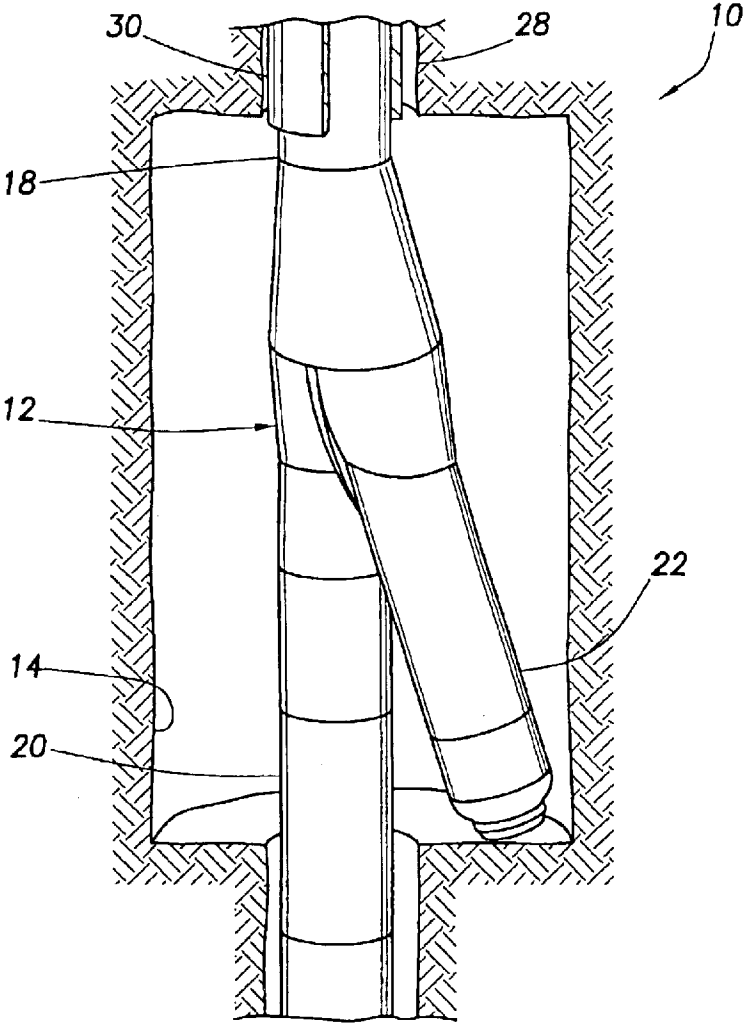
FIG. 3 is a cross-sectional perspective view of the method, wherein the junction has been expanded within the under-reamed cavity.

Referring specifically now to FIG. 3, the junction 12 has been radially outwardly expanded by applying pressure to the junction assembly 32, thereby creating a pressure differential from the interior to the exterior of the junction. In its expanded configuration, the lateral leg 22 extends outward from the junction assembly 32 in the cavity 14. However, it is not expected that the junction 12 will perfectly resume its pre-collapsed shape when inflated. Unfortunately, such imperfect expansion can restrict access and flow through the junction 12, prevent certain equipment from being properly positioned, oriented, connected, etc. to the junction, and may cause other problems.

Figure 4:
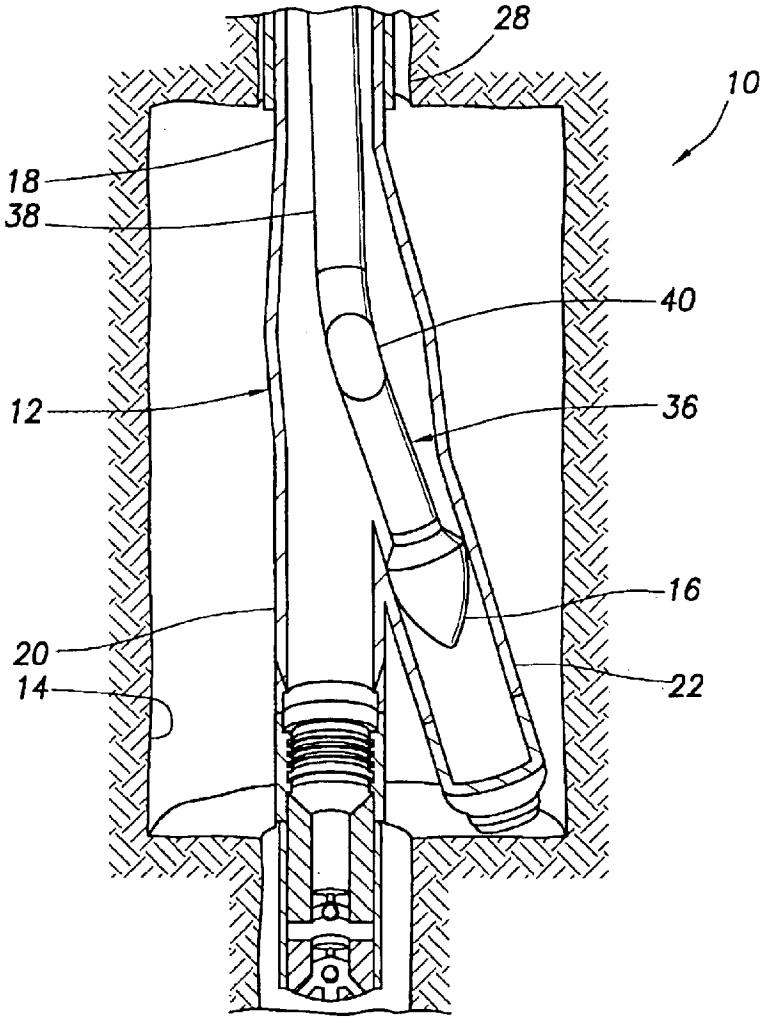
FIG. 4 is cross-sectional perspective view of the method, wherein the expanded junction is drifted.

Referring specifically now to FIG. 4, the method 10 includes provisions for overcoming the difficulties caused by imperfect inflation of the junction 12. The drift 16 is conveyed into the junction assembly 32 as part of an overall drifting apparatus 36. The drifting apparatus 36 as depicted in FIG. 4 includes the drift 16 and a tubular string 38, such as segmented drill pipe, for conveying the apparatus 36 downhole. The apparatus 36 may include other or different elements in keeping with the principles of the invention.

As used herein, the term "drift" is used to indicated a tool which is forced through a passage to thereby reform the interior of the passage, so that it takes on a desired shape. In the representatively illustrated method 10, the drift 16 has a round cross-sectional shape, since it is desired to produce a substantially cylindrical shape in the legs 18, 20, 22 of the junction 12. However, other shapes may be used in keeping with the principles of the invention. The legs 18, 20, 22 may be expanded when the drift 16 is displaced therethrough.

Using the apparatus 36, each of the legs 18, 20, 22 may be drifted (i.e., physically extended outward to a known desired dimension) by displacing the drift 16 therein. For example, to drift the upper leg 18, the apparatus 36 is lowered by the tubular string 38, so that the drift 16 passes through the leg, thereby reforming the inner diameter of the leg so that it assumes a substantially cylindrical shape having substantially the same dimension as the outer diameter of the drift.

If the lower leg 20 is substantially coaxial with the upper leg 18, or possibly in other circumstances, the lower leg may be drifted in the same manner as the upper leg. Of course, the main body of the junction 12 between the upper and lower legs 18, 20 may also be drifted in the same manner. However, it should be understood that it is not necessary for the upper and lower legs 18, 20 to be substantially coaxial, or for the main body of the junction 12 to extend substantially linearly between the upper and lower legs, in keeping with the principles of the invention.

Since the lateral leg 22 of the representatively illustrated junction 12 is not coaxial with the upper leg 18, the drifting apparatus 36 may include provisions for directing the drift 16 to enter the lateral leg. As depicted in FIG. 4, the apparatus 36 includes a conventional knuckle joint 40 to angularly offset the drift 16 relative to the tubular string 38 above the knuckle joint.

The knuckle joint 40 may be any type of knuckle joint, for example, a mechanical or pressure actuated knuckle joint, etc. Preferably, the knuckle joint 40 is pressure actuated, so that when the drift 16 has been positioned in the junction 12, pressure may be applied to the tubular string 38 to radially outwardly displace the drift. After the knuckle joint 40 has been actuated, the drift 16 is displaced in the lateral leg 22, for example, by lowering the tubular string 38.

Figure 5:
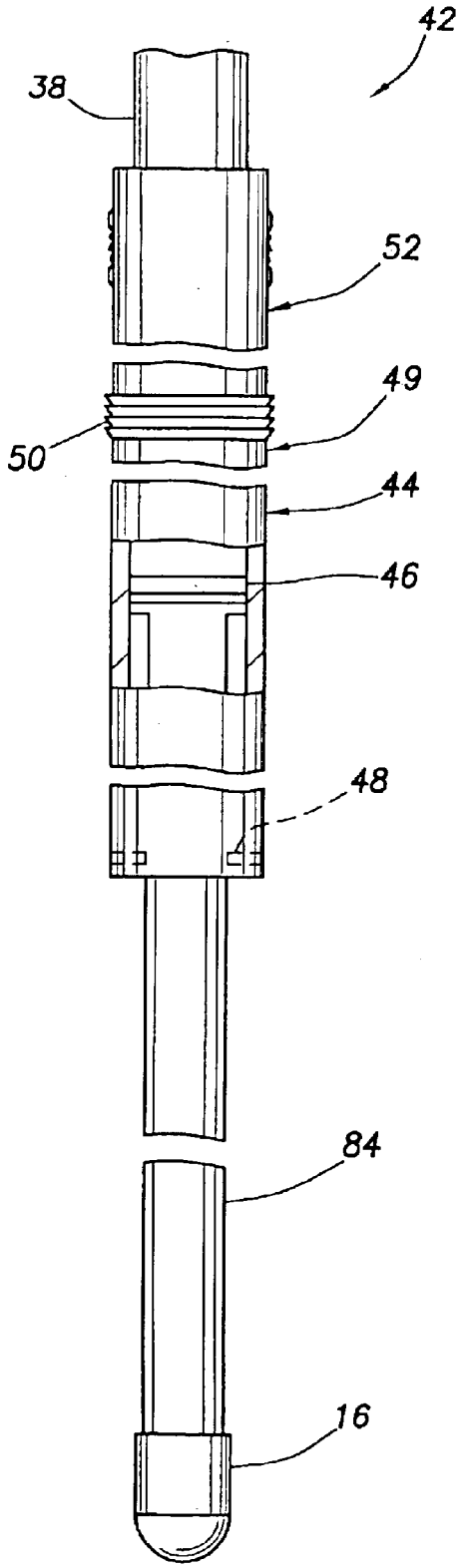
FIG. 5 is a partially cross-sectional view of a first drifting apparatus which may be used in the method, the apparatus embodying principles of the invention.

Referring specifically now to FIG. 5, an alternate drifting apparatus 42 is representatively illustrated. The apparatus 42 may be used in place of the apparatus 36 in the method 10. Other means of drifting the junction 12 may be used in keeping with the principles of the invention.

Instead of using manipulations of the tubular string 38 to displace the drift 16 in the legs 18, 20, 22 of the junction 12, the apparatus 42 utilizes a pressure actuated displacement device 44. As depicted in FIG. 5, the displacement device 44 is an axial extension device which includes a piston 46 exposed to pressure in the tubular string 38.

When pressure in the tubular string 38 exceeds a predetermined level, shear pins or shear ring 48 shear, permitting the piston 46 to displace downward. Other types of shear members, or other types of release mechanisms may be used in place of the shear pins 48. The piston 46 is attached to the drift 16, so that as the piston 46 displaces downward, so does the drift.

To anchor the extension device 44 in place while the drift 16 is being displaced in the junction 12, an anchoring or securing device 49 is included in the apparatus 42. The anchoring device 49 includes at least one gripping structure 50, such as a slip of the type conventionally used on packers, liner hangers, etc.

The gripping structure 50 is radially outwardly extended when a predetermined pressure is applied to the tubular string 38. The pressure used to actuate the anchoring device 49 is preferably less than the pressure used to shear the pins 48. Other types of anchoring devices and gripping structures may be used in the apparatus 42 in keeping with the principles of the invention. For example, the gripping structure 50 could be outwardly extended by manipulation of the tubular string 38, etc.

When outwardly extended, the gripping structure 50 grippingly engages a portion of the junction assembly 32, such as in a section of liner 34, thereby fixing the axial position of the drifting apparatus 42 in the junction assembly. Such gripping engagement also preferably fixes the radial orientation of the drifting apparatus 42 relative to the junction 12, for reasons explained below.

The drifting apparatus 42 may also, or alternatively, include a securing device or latch 52 to aid in positioning the drifting apparatus 42 in the junction assembly 32. For example, the latch 52 may be used to provide an indication to an operator at the surface that the drifting apparatus 42 is appropriately positioned in the junction assembly 32. The latch 52 may also releasably retain the drifting apparatus 42 in position in the junction assembly 32 until the anchoring device 49 is actuated.

The latch 52 is configured to engage a latch profile 54 included in the junction assembly 32 (see FIG. 6). The latch profile 54 may be positioned anywhere in the junction assembly 32, and any number of latch profiles may be used, but preferably at least one latch profile is positioned above the upper leg 18 of the junction 12, and another latch profile 56 is positioned below the lower leg 20, as depicted in FIG. 6.

The upper latch profile 54 permits the drifting apparatus 42 to be appropriately positioned in the junction assembly 32 before, during and after drifting the upper leg 18. The lower latch profile 56 permits appropriate positioning of other equipment in the junction assembly 32 (as described below) after the drifting of at least the upper leg 18 and the lower leg 20.

For reasons explained below, the latch 52 is preferably of the type known to those skilled in the art as an orienting latch, and the profiles 54, 56 are preferably orienting latch profiles. That is, the engagement between the latch 52 and either of the latch profiles 54, 56 serves to radially orient the latch relative to the latch profile. Thus, when the latch 52 in the drifting apparatus 42 is properly engaged with the latch profile 54, the drifting apparatus is radially oriented in a particular direction relative to the junction assembly 32. A suitable latch and latch profile which may be used for the latch 52 and profile 54 is available from Halliburton Energy Services. Inc. as the Sperry-Sun Latch Coupling with Orienting Sub.

Note that it is not necessary in the method 10 for the drifting apparatus 42 to be radially oriented relative to the junction assembly 32. However, when such radial orientation is desired, as explained below, the latch 52 and profile 54 are available to perform this function. For example, the latch 52 may be included in the drifting apparatus 36 depicted in FIG. 4 to radially orient the apparatus 36 so that when the knuckle joint 40 is actuated, the drift 16 is directed in the appropriate radial direction to displace toward the lateral leg 22 of the junction 12.

The drifting apparatus 42 may be used to drift the upper leg 18 as follows: Convey the drifting apparatus 42 on the tubular string 38 into the junction assembly 32. Engage the latch 52 with the latch profile 54 and apply a predetermined pressure to the tubular string 38, to thereby actuate the anchoring device 49 and fix the axial and radial position of the apparatus 42 in the assembly 32. Apply an increased predetermined pressure to the tubular string 38 to thereby actuate the extension device 44 (i.e., displace the piston 46) and thereby displace the drift 16 in the leg 18. When the drifting is completed, pressure in the tubular string 38 may be relieved to enable the gripping structure 50 to retract for retrieval of the apparatus 42 from the well.

If the extension device 44 is suitably configured, and if the junction legs 18, 20 are substantially coaxial, both of the junction legs 18, 20 may be drifted in a single trip into the well by continuing to displace the drift 16 downward through the main body of the junction 12 and into the lower leg 20 after drifting the upper leg 18. Alternatively, the legs 18, 20 may be drifted in separate trips into the well.

If, as described above, the junction 12 is radially oriented in the cavity 14 so that the lateral leg 22 faces toward the high side of the wellbore 28, then equipment conveyed through the junction from above will enter the lower leg 20, due to the force of gravity. This situation is advantageous in that it requires no special equipment or procedures to select the lower leg 20 for entry. Another benefit is that it enables selection of the lateral leg 22 for entry by using gravity sensing equipment, such as high side detectors, MWD tools, etc.

The upper latch profile 54 provides yet another method of selecting the lateral leg 22 for entry. Preferably, before and/or during running the junction assembly 32 into the well, the latch profile 54 is oriented so that it has a known radial orientation relative to the lateral leg 22. For example, since the distance between the junction 12 and the position of the latch profile 54 in the junction assembly 32 may be too great to conveniently fix the radial orientation of the latch profile relative to the junction prior to running the assembly into the well, a tool, such as a gyroscope, may be used to indicate the relative radial orientation of the lateral leg 22 after the junction has been run into the well and when the latch profile is connected to the assembly.

Of course, other means of radially orienting the latch profile 54 (or the latch profile 56) relative to the lateral leg 22 may be used in keeping with the principles of the invention. In addition, the latch profile 54 could be specifically oriented relative to another portion of the junction 12, or another portion of the junction assembly 32, without departing from the principles of the invention.

Figure 7:
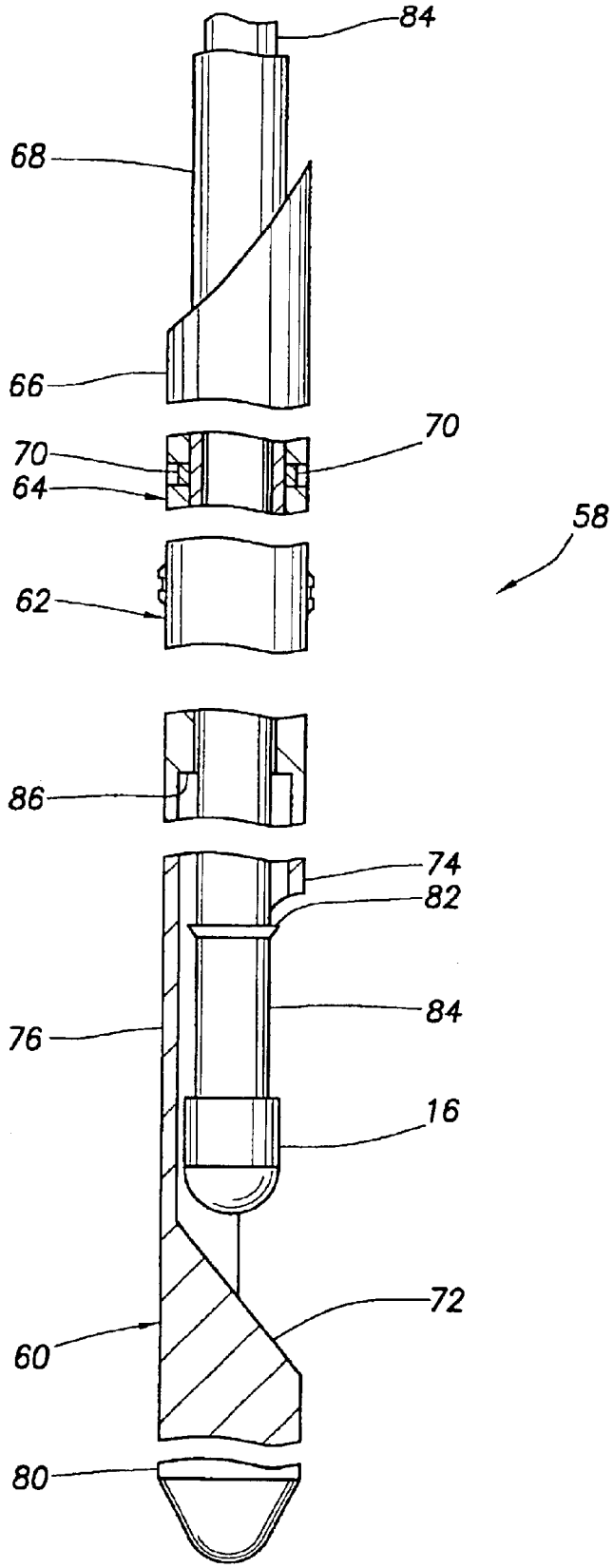
FIG. 7 is a partially cross-sectional view of a second drifting apparatus which may be used in the method, the second apparatus embodying principles of the invention.

In the representatively illustrated method 10, when it is desired to drift the lateral leg 22, a modification is made to the drifting apparatus 42 to permit the drift 16 to enter the lateral leg. Referring specifically now to FIG. 7, a deflection device assembly 58 is added to the drifting apparatus 42 to deflect the drift 16 toward the lateral leg 22.

The deflection device assembly 58 includes a deflection device 60, a latch 62, a releasing device 64, an upwardly facing muleshoe 66 and a generally tubular housing 68. The housing 68 is attached to the displacement device 44 of the drifting apparatus 42, so that the deflection device assembly 58 is conveyed into the well as part of the drifting apparatus.

However, the housing 68 is releasably attached to the deflection device assembly 58 using the releasing device 64. The releasing device 64 includes lugs 70 which retract when a predetermined pressure is applied to the tubular string 38, to thereby release the remainder of the deflection device assembly 58 for axial displacement relative to the rest of the drifting apparatus 42. The lugs 70 also maintain a radial orientation of the deflection device assembly 58 relative to the latch 52, until the lugs are retracted. Other types of releasing devices, such as shear pins, J-slots, etc., may be used in place of, or in addition to, the releasing device 64.

The deflection device 60 includes a laterally inclined deflection surface 72, an upper generally tubular neck 74, and an intermediate section 76 extending between the neck and the deflection surface. As described above, the junction 12 is expected to be somewhat imperfectly reformed after it is inflated. Since the deflection device 60 is configured to extend into both the upper leg 18 and the lower leg 20 when installed in the junction 12, the intermediate section 76 is preferably substantially flexible. In this manner, a degree of angular misalignment between the upper and lower legs 18, 20 may be accommodated by flexing in the intermediate section 76.

In the method 10, the drifting apparatus 42 including the deflection device assembly 58 is conveyed into the well after both the upper and lower legs 18, 20 have been drifted as described above. When the latch 52 engages the latch profile 54, the deflection device 60 is radially oriented so that the deflection surface 72 faces toward the lateral leg 22. The tubular string 38 is lowered further, thereby causing the latch 62 on the deflection device assembly 58 to engage another latch profile 78 in the junction assembly 32.

Since, at this point, the deflection device 60 is already radially oriented relative to the junction 12, this engagement between the latch 62 and the profile 78 preferably does not radially orient the deflection device, but serves instead to axially and rotationally secure the deflection device assembly 58 in the junction assembly 32. However, engagement between the latch 62 and the profile 78 could radially orient the deflection device 60 if desired, without departing from the principles of the invention. A suitable latch and profile which may be used for the latch 62 and profile 78 is available from Halliburton Energy Services, Inc. as the Sperry-Sun Double Collet Latch Coupling.

When the latch 62 engages the profile 78, the neck 74 is preferably positioned in the upper leg 18 and a bull plug 80 attached to a lower end of the deflection device 60 is positioned in the lower leg 20. As described above, this positioning of the deflection device 60 in the junction 12 may result in flexing of the intermediate section 76 to accommodate any misalignment between the upper and lower legs 18, 20.

A predetermined pressure is then applied to the tubular string 38 to retract the lugs 70 and release the deflection device assembly 58 for displacement relative to the remainder of the drifting apparatus 42. Preferably, the pressure required to retract the lugs 70 is less than the pressure required to extend the gripping structure 50, and is less than the pressure required to shear the shear pins 48 to thereby permit the piston 46 of the displacement device 44 to displace, so that the deflection device assembly 58 is released prior to anchoring the drifting apparatus 42 and prior to displacing the drift 16 using the displacement device.

After the deflection device assembly 58 has been released, the drifting apparatus 42 is operated as described above, i.e., by applying an increased pressure to the tubular string 38 to extend the gripping structure 50, and then further increasing the pressure to displace the drift 16 downward. However, when the drift 16 eventually contacts the deflection surface 72, it is deflected laterally, so that it enters the lateral leg 22, instead of the lower leg 20. Further displacement of the drift 16 in the lateral leg 22 acts to drift the lateral leg to a desired inner dimension or geometry.

After the lateral leg 22 has been drifted, pressure on the tubular string 38 is relieved, thereby permitting the gripping structure 50 to retract. The tubular string 38 may then be raised to retrieve the drifting apparatus 42, disengaging the latch 52 from the latch profile 54. The deflection device assembly 58 may be retrieved along with the remainder of the drifting apparatus 42 by provision of a radially enlarged shoulder 82 on a mandrel 84 extending between the displacement device 44 and the drift 16. When the drifting apparatus 42 is raised, the mandrel 84 is also raised, causing the shoulder 82 to contact a no-go shoulder 86 attached to the deflection device 60. This contact between the shoulders 82, 86 permits retrieval of the deflection device assembly 58 along with the remainder of the drifting apparatus 42. Thus, the drifting apparatus 42 including the deflection device assembly 58 may be installed in the junction assembly 32 and retrieved therefrom in a single trip into the well.

Note that many other means of positioning the deflection device 60 in the junction assembly 32 may be used in keeping with the principles of the invention. For example, the deflection device 60 could be radially oriented relative to the junction 12 by attaching a latch, such as the latch 52, between the bull plug 80 and the deflection device. This latch would engage the latch profile 56 below the lower leg 20, thereby radially orienting and axially securing the deflection device 60 relative to the junction 12.

Figure 8:
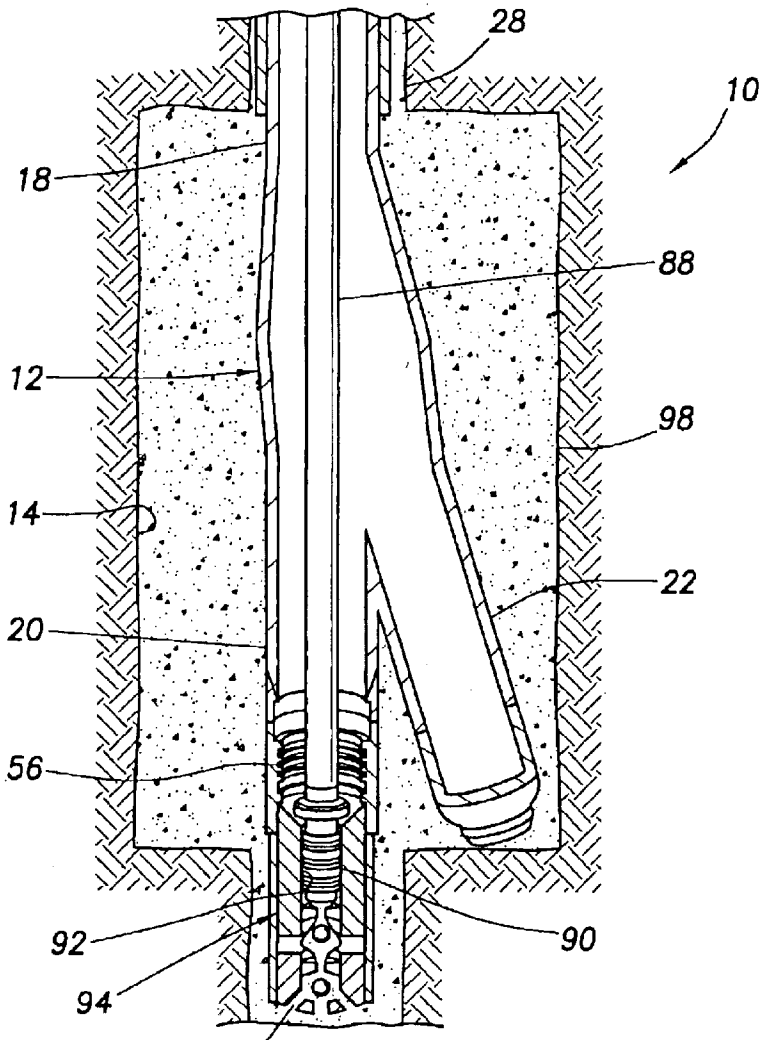
FIG. 8 is a cross-sectional perspective view of the method, wherein the expanded junction is cemented within the cavity.

Referring specifically now to FIG. 8, the junction 12 is cemented in the cavity 14 after the drifting operations are completed. As used herein, the terms "cement" and "cementing" are used broadly to encompass the use of any hardenable liquid or slurry to secure and seal equipment in a wellbore, although, technically speaking, the hardenable liquid or slurry may not actually contain a cementitious material. For example, the use of an epoxy or other polymercontaining hardenable liquid may be considered "cementing", and the hardenable fluid or slurry may be referred to as "cement". As used herein, the terms "harden" and "hardenable" are used broadly to indicate increased rigidity and strength, and such terms encompass the use of materials such as gels which, although they may not solidify, become more rigid and have increased strength.

To cement the junction 12 in the cavity 14, another tubular string 88 is conveyed into the junction assembly 32. A sealing device or stinger 90 attached to a lower end of the tubular string 88 is stung into a seal bore 92 of a cementing device 94 attached to a lower end of the lower leg 20. The cementing device 94 includes at least one valve 96 selectively permitting and preventing flow through the cementing device.

The valve 96 is closed when pressure is applied to the interior of the junction 12 to inflate it. The valve 96 is opened when it is desired to flow cement 98 from the tubular string 88 through the cementing device 94, and outward into the cavity 14 surrounding the junction 12. The tubular string 88 is retrieved from the well along with the stinger 90 when the cementing operation is completed.

Referring specifically now to FIG. 9, after the cement 98 has hardened, the cementing device 94 may be drilled through by conveying a cutting device, such as one or more mill or drill 100 into the junction assembly 32. The drill 100 may also be used to form the wellbore 24 extending outwardly from the lower leg 20. As described above, the wellbore 28 may extend below the cavity 14 prior to the junction 12 being positioned therein, in which case the drill 100 may be used to further extend the wellbore 28.

Figure 10:
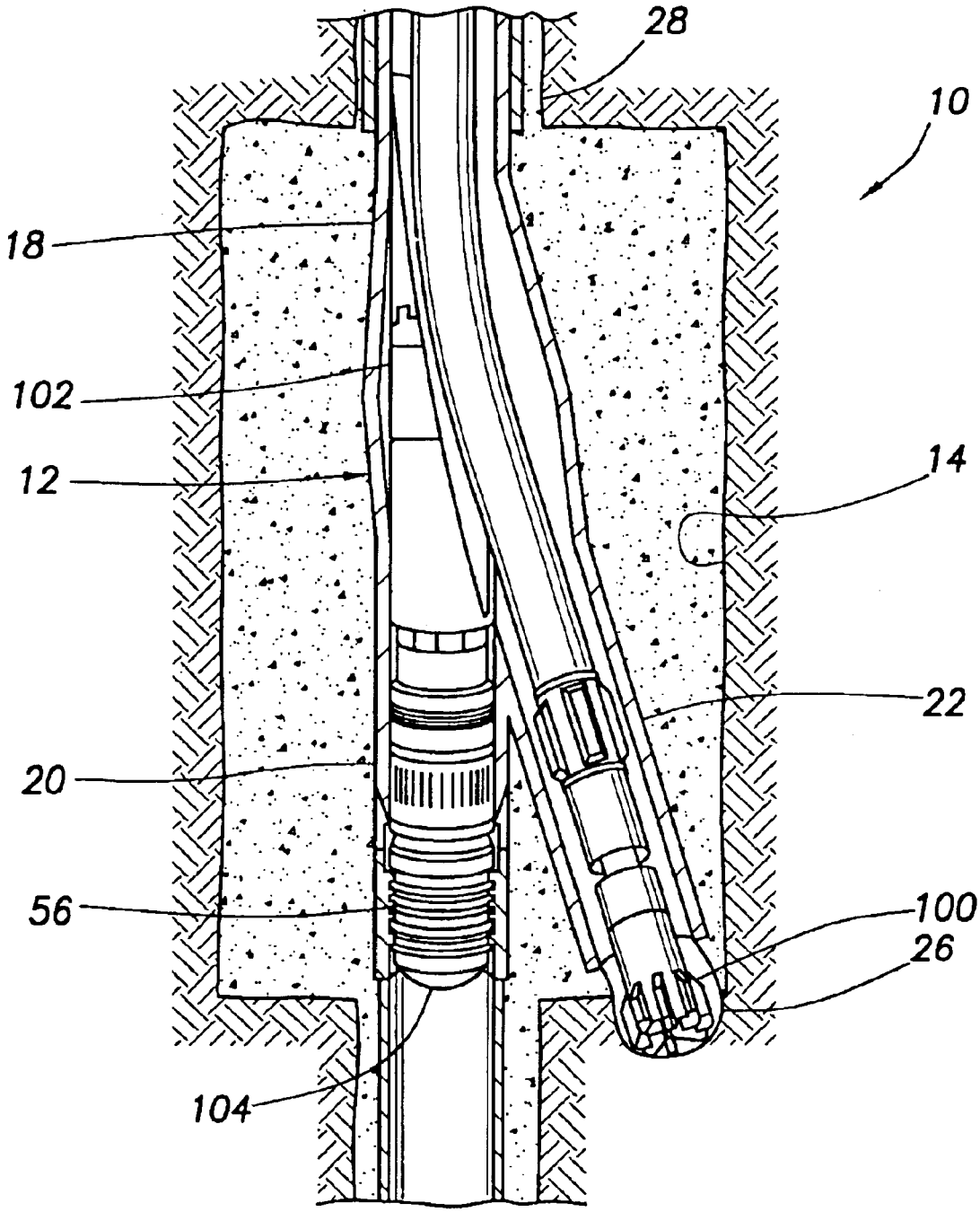
FIG. 10 is a cross-sectional perspective view of the method, wherein another wellbore is drilled through another lower leg of the junction.

Referring specifically now to FIG. 10. The wellbore 26 may be formed extending outwardly from the lateral leg 22 using the drill 100 by first positioning a deflection device, such as a drilling whipstock 102, in the junction 12. Note that the whipstock 102 has an orienting latch 104 attached to a lower end thereof for engagement with the latch profile 56 below the lower leg 20. In this manner, the whipstock 102 is radially oriented and axially secured relative to the junction 12 when the latch 104 is engaged with the profile 56.

Alternatively, the same deflection device 60 used to drift the lateral leg 22 may be used as the drilling whipstock 102.

After the wellbores 24, 26 have been drilled, or either of them has been drilled, tubular strings, such as liners, screens, etc. may be positioned in the wellbores and cemented therein, or the wellbores may be completed open hole if desired. If tubular strings are used, these tubular strings may be conveniently attached and sealed to the legs 20, 22 using conventional techniques, such as by using liner hangers, packers, etc., since the legs have been previously drifted and, thus, are well suited for sealing engagement and/or attachment thereto. Note that the method 10 thus provides a sealed wellbore intersection that is convenient and economical in installation, while permitting unhindered access to each wellbore and pressure isolation between the interior of the junction 12 and a formation surrounding the junction.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. An expandable wellbore junction system, comprising:

a wellbore junction assembly including:

an expandable wellbore junction having multiple intersecting tubular legs, and an orienting latch profile attached to the wellbore junction;

a drifting apparatus including a drift displaceable through at least one of the tubular legs of the wellbore junction, thereby reforming an interior geometry of the at least one of the tubular legs; and a deflection device releasably secured to the drifting apparatus, the drifting apparatus, and the deflection device releasably secured thereto, being insertable into and positionable in a predetermined radial orientation within the wellbore junction.

2. The system according to claim 1, wherein the drifting apparatus and the deflection device releasably secured thereto are radially oriented relative to the wellbore junction by engagement of the deflection device with the orienting latch profile.

3. The system according to claim 1, wherein the deflection device, when installed in the wellbore junction, is operative to deflect the drift to displace toward the at least one of the wellbore junction tubular legs.

4. An expandable wellbore junction system, comprising:

a wellbore junction assembly including:

an expandable wellbore junction having multiple intersecting tubular legs, and an orienting latch profile attached to the wellbore junction; and a drifting apparatus which includes a drift, a gripping structure and an axial extension device, the gripping structure anchoring the drifting apparatus to the wellbore junction assembly, and the extension device displacing the drift in at least one of the wellbore junction tubular legs, the gripping structure being outwardly extended into gripping engagement with the wellbore junction assembly by a first predetermined pressure applied to the drifting apparatus, and the extension device displacing the drift in response to a second predetermined pressure applied to the drifting apparatus; and a deflection device releasably attached to the drifting apparatus, the deflection device being released for displacement of the drifting apparatus relative to the deflection device by application of a third predetermined pressure to the drifting apparatus.

5. The system according to claim 4, wherein the third pressure is less than each of the first and second pressure.

6. An expandable wellbore junction system, comprising:

a wellbore junction assembly including an expandable wellbore junction having multiple intersecting tubular legs, and an orienting latch profile attached to the wellbore junction, the wellbore junction assembly being attached to a tubular string in a first wellbore and extending outwardly from the tubular string into an enlarged cavity formed in the first wellbore, the wellbore junction being expanded outward within the cavity due to fluid pressure applied to the interior surface of the wellbore junction, the wellbore junction being cemented within the cavity, and at least first and second wellbores being formed through the wellbore junction tubular legs and through cement surrounding the wellbore junction in the cavity.

* * * * *